United States Patent [19]

Pendergrass

[11] 4,400,017

[45] Aug. 23, 1983

[54] INTEGRATED BUDGET AND CHECK RECORD BOOK

[76] Inventor: Russell G. Pendergrass, Rte. 4, Mont Pelia Rd., Martin, Tenn. 38237

[21] Appl. No.: 272,100

[22] Filed: Jun. 10, 1981

Related U.S. Application Data

[63] Continuation-in-part of Ser. No. 240,553, Mar. 4, 1981.

[51] Int. Cl.[3] ..... B42D 12/00

[52] U.S. Cl. ..... 283/66 A; 283/58

[58] Field of Search ..... 283/1 R, 38, 41, 42, 283/43, 63 R, 63 A, 66 R, 66 A, 60 R, 60 A; 281/15, 16

[56] References Cited

U.S. PATENT DOCUMENTS

| | | | |
|---|---|---|---|
| 303,440 | 8/1884 | Levy | 283/38 |
| 600,253 | 3/1898 | Barnes | 283/63 A |
| 714,003 | 11/1902 | Marshall | 283/43 |
| 790,831 | 5/1905 | Hansell | 283/63 A |
| 1,324,665 | 12/1919 | Green | 283/66 R |
| 1,325,243 | 12/1919 | Fuller . | |
| 1,416,239 | 5/1922 | Smith | 283/57 |
| 1,494,201 | 5/1924 | Whitehead | 283/63 A |
| 1,588,185 | 6/1926 | Groby | 283/66 A |
| 2,244,908 | 6/1941 | Finnila | 283/66 A |

FOREIGN PATENT DOCUMENTS

| | | | |
|---|---|---|---|
| 81282 | 7/1956 | Denmark | 283/63 A |

*Primary Examiner*—Paul A. Bell
*Assistant Examiner*—John S. Brown
*Attorney, Agent, or Firm*—Schwartz, Jeffery, Schwaab, Mack, Blumenthal & Koch

[57] ABSTRACT

A register for recording budget items and check items. The register has a first plurality of sheets for recording budget items and a second plurality of sheets for recording check items wherein at least a portion of said second plurality of sheets is also reserved for recording a budget category. The first and second plurality of sheets are secured for movement about a central axis in book-like fashion and are independently movable with respect to each other for permitting alignment of longitudinal lines contained on the first plurality of sheets with longitudinal lines contained on the second plurality of sheets.

21 Claims, 10 Drawing Figures

| EXPENDITURE CATEGORY WORKSHEET | | | | | |
|---|---|---|---|---|---|
| I FOOD | | IV CLOTHES | | VII MISCELLANEOUS | |
| 1st two weeks | $215 | COAT | 80 | News paper | 8.00 |
| 2nd two weeks | $180 | Shoes | 50 | School | 195.00 |
| Food storage | $45 | Children | 120 | books | 40.00 |
| Dining out | $35 | Dry cleaning | 25 | Entertainment | 60.00 |
| School lunchs | $18 | | | Hairdresser | 35.00 |
| | $493 | | | Photographs | 75.00 |
| II HOUSE | | | $275 | birthday Presant | 150.00 |
| Mortgage | $430 | V MEDICAL / DENTAL | | | |
| utilities | $125 | Dent checkup | $30 | | |
| phone | $55 | Insurance | $60 | | |
| Appliance | $40 | | | | |
| lawn tools | $65 | | | | 563 |
| | | | $90 | FOOD | 493 |
| | $815 | VI SAVINGS/CHARITY | | HOUSE | 815 |
| III TRANSPORTATION | | SAV ACCT | $100 | TRANSP | 253 |
| Gas | $50 | BONDS | $120 | CLOTHES | 275 |
| METRO | $33 | TITHE | $310 | MED / DENT | 90 |
| Insurance | $50 | Vacation | $60 | SAV/ CHAR | 665 |
| Repairs | $120 | Christmas | $75.00 | MISCELLANEOUS | 563 |
| | $253 | | 665 | TOTAL | $3,154 |

FIG. 9

INTEGRATED BUDGET AND CHECK RECORD BOOK

CROSS REFERENCE TO RELATED APPLICATION

This application is a continuation-in-part of Ser. No. 240,553, filed Mar. 4, 1981, entitled "Accounting Systems and Devices for Practicing Same".

BACKGROUND AND SUMMARY OF THE INVENTION

This invention relates to accounting systems in general, and in particular, to an accounting system devised for use by an individual who wishes to maintain a predetermined monthly budget by deducting expenses as they occur, i.e., a conveniently portable budgeting system.

In addition to providing portable budget maintenance for individuals, this device provides an accurate and comprehensive method of maintaining expenditure records in that it provides for the recording of check, cash, and charge account expenditures (for each of seven separate budget categories) at the time they occur.

Millions of people utilize checking accounts and carry their checkbooks and checkregisters with them wherever they go. This device is designed to replace the checkregister without sacrificing any of the important information these records provide a customer. The checkregister and portable budget record are combined in a small booklet. In one embodiment of the invention, perforations or serrations are provided on the pages and, once torn by the customer, two groups of pages are provided for independent movement of the pages in group of the record book.

In an alternate arrangement of the invention, the pages are cut into two groups by the manufacturer and the record book is completely ready for use by the customer.

The average individual realizes that budgeting is the only way he can get the most out of his income dollars. Unfortunately, until now, budget conscious people had to write notes to themselves, carry receipts around with them, or commit an expense to memory so they could record it in a large $8\frac{1}{2}'' \times 11''$ budget book when they returned home. The system of the present invention makes it possible to record an expense, regardless of the payment method used, at the time it is incurred and deduct that expense from a predetermined amount set aside in the applicable budget category.

In addition to a budget record and check record, this invention provides the customer with a page to record deposits, a page to compute net income for one month and break that income down into seven separate budget categories, a calendar page, and a page for recording projected expenditures for one month—those expenses being placed in the applicable budget categories provided for by this particular page.

The system of present invention has been devised such that the customer will be provided twelve of the small budget booklets to be stored in a small file box and separated by file cards with designated months. In addition, a combination financial advisor and annual workbook will be provided to the customer to explain, illustrate, supplement and expound upon the budgeting concepts inherent in this invention.

BRIEF DESCRIPTION OF THE DRAWINGS

The details and advantages of this invention will become more apparent in the following detailed specifications, descriptions, and drawings, of which:

FIG. 9 illustrates a page of the workbook of FIG. 8; and

DETAILED DESCRIPTION OF THE PREFERRED EMBODIMENT

Figure 1:
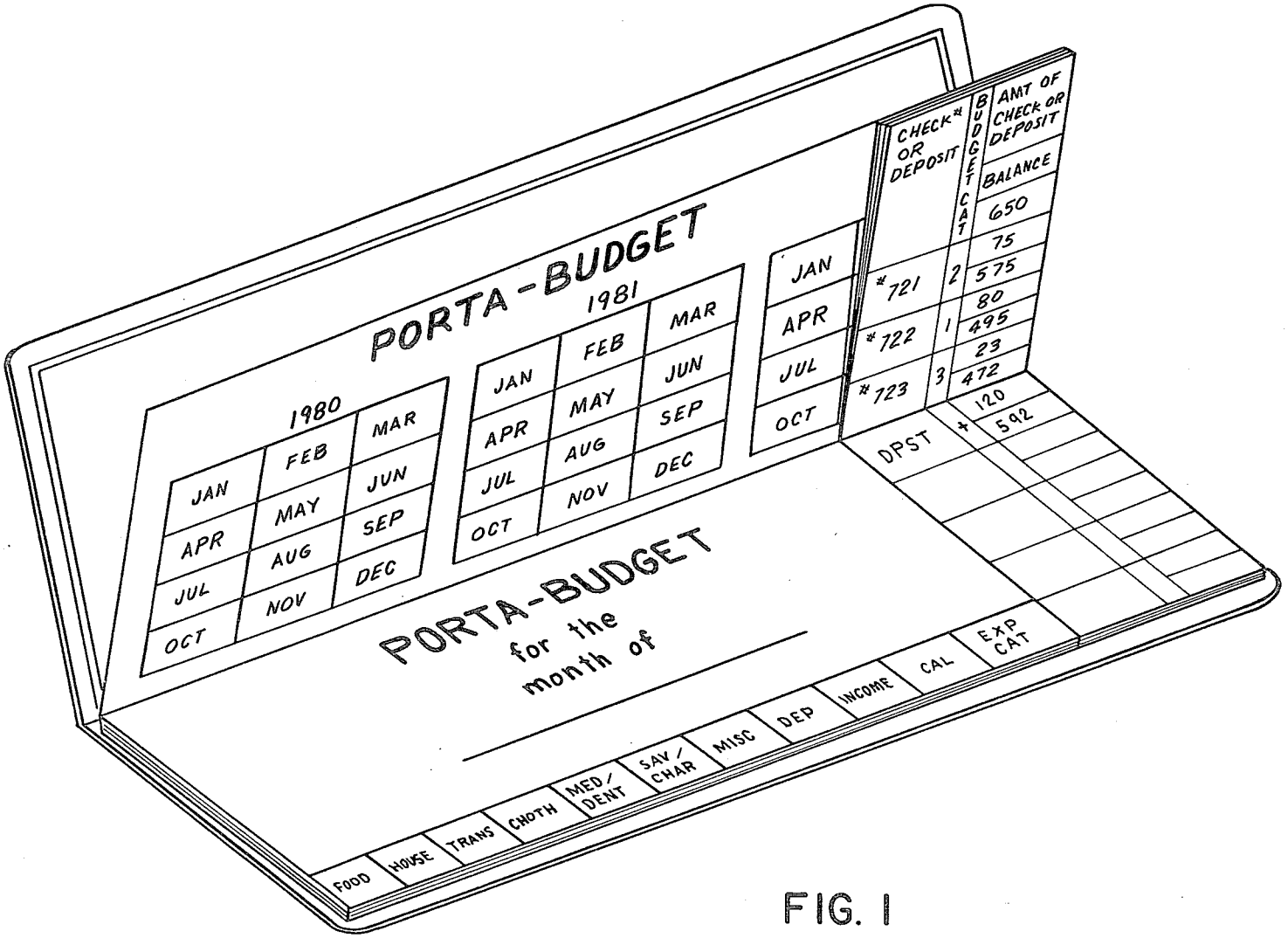
FIG. 1 is a perspective view of one embodiment of the invention.

FIG. 1 is a perspective view of the invention in a pocket case with an accompanying book of checks. The pocket case is designed with a pocket on the left side of the portion of the case which holds the checks A and a pocket across the top of the portion of the case which holds the checks B. This pocket case has been specially constructed so as to accommodate both checks which are bound on the top and ones which are bound on the left side.

Figure 2:
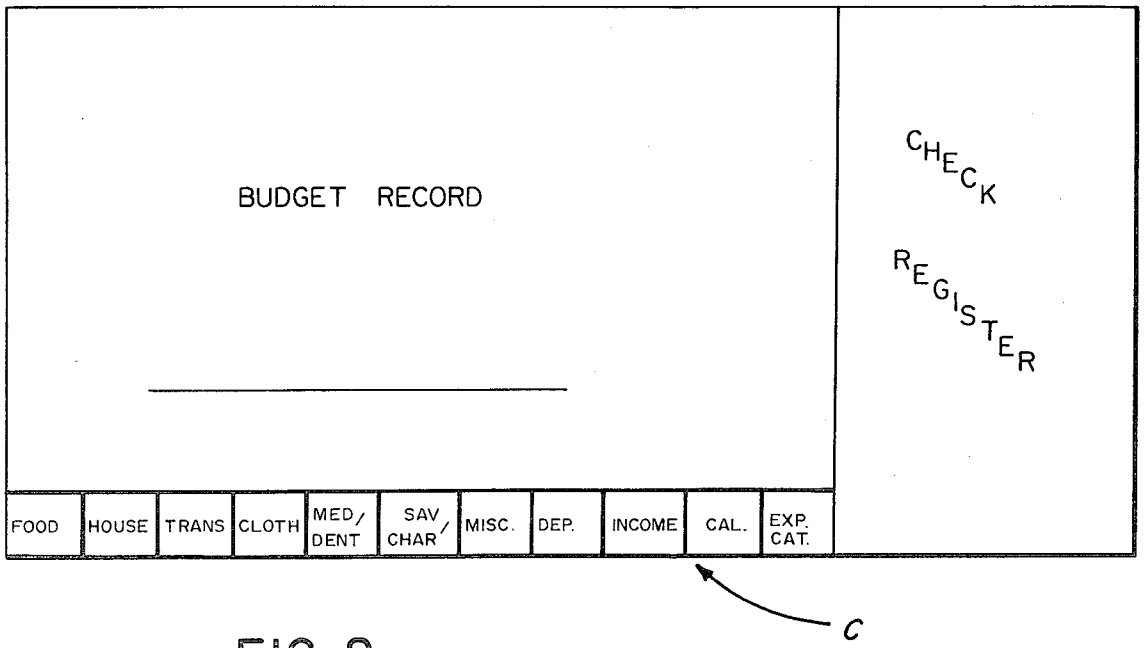
FIG. 2 is a plan view of the front of the budget booklet of the embodiment of FIG. 1.

FIG. 2 is a plan view of the front of the budget booklet. The booklet is constructed so that the tabs for each budget category and tabs for the supplementary sheets included are visible at a glance to the customer C, who may utilize the tabs to quickly index and flip to the desired budget category.

Figure 3:
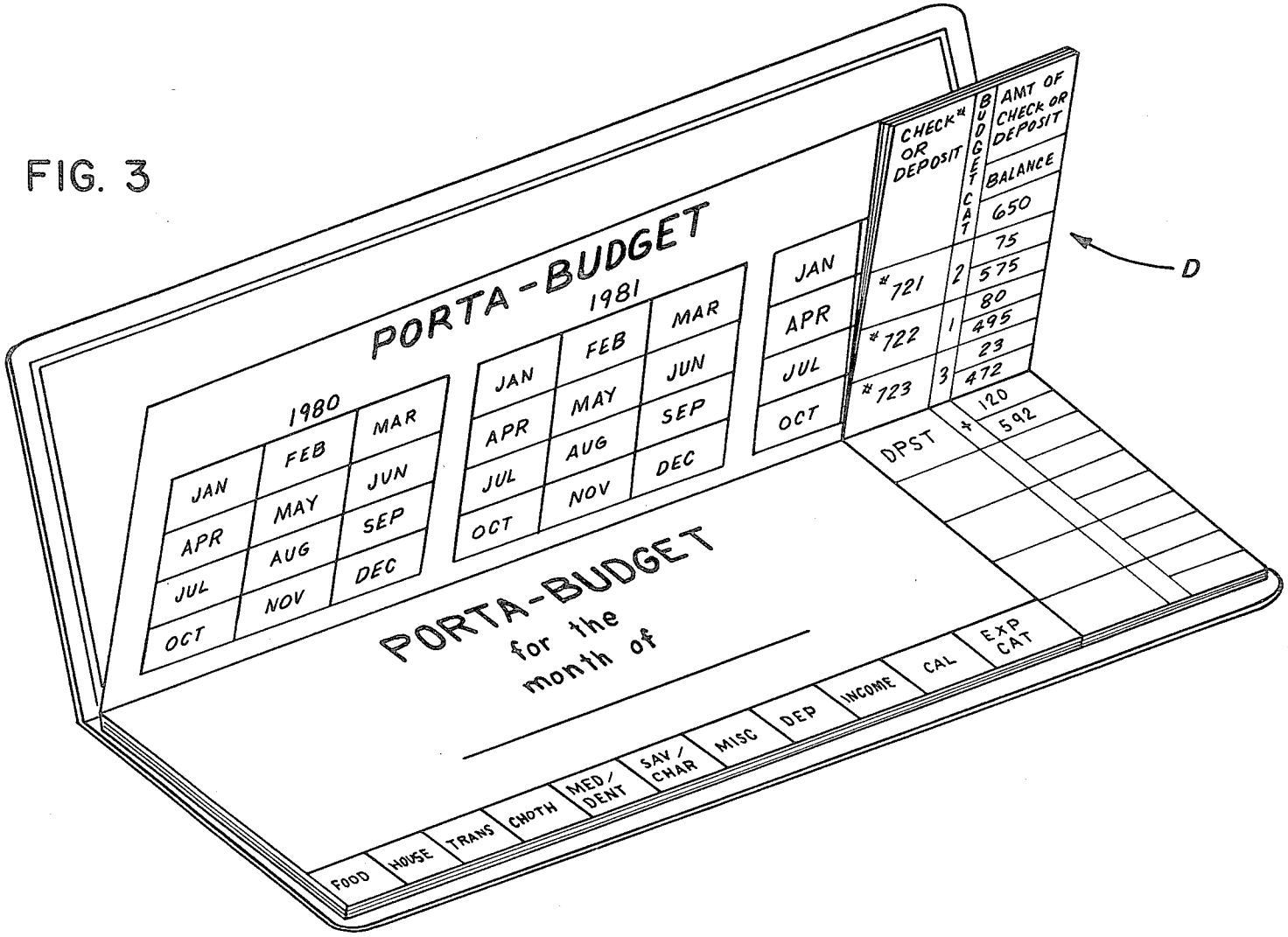
FIG. 3 is a perspective view of the record book of the embodiment of FIG. 1 illustrating the independent turning of the budget and check record pages.

FIG. 3 is a perspective view of the booklet illustrating the independent turning of the check register pages D.

Figure 4:
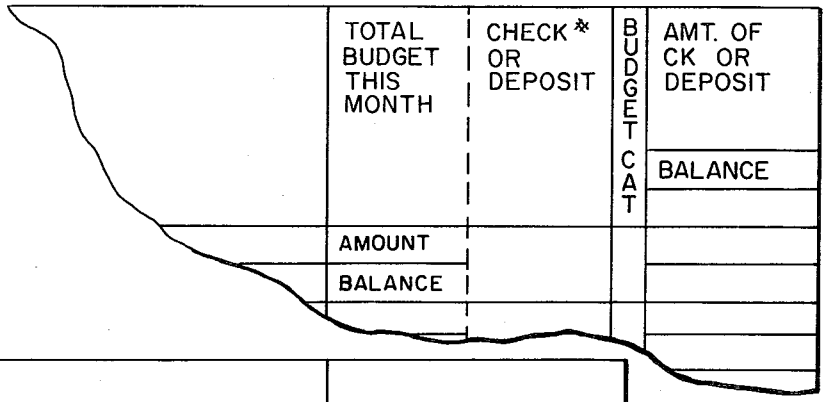
FIG. 4 shows the perforations or serrations of the record book of FIG. 1.

FIG. 4 illustrates one embodiment of the invention wherein the booklet may be manufactured so the right side of the budget record and the left side of the check register are separated (or connected, depending on your preference) by perforations or serrations in the page. When a customer receives the record book, he tears these pages along their perforated or serrated edges, separating the check register from the budget record. This provides for independent movement of the pages in both records. The advantages of this novel construction will be illustrated later.

Figure 5:
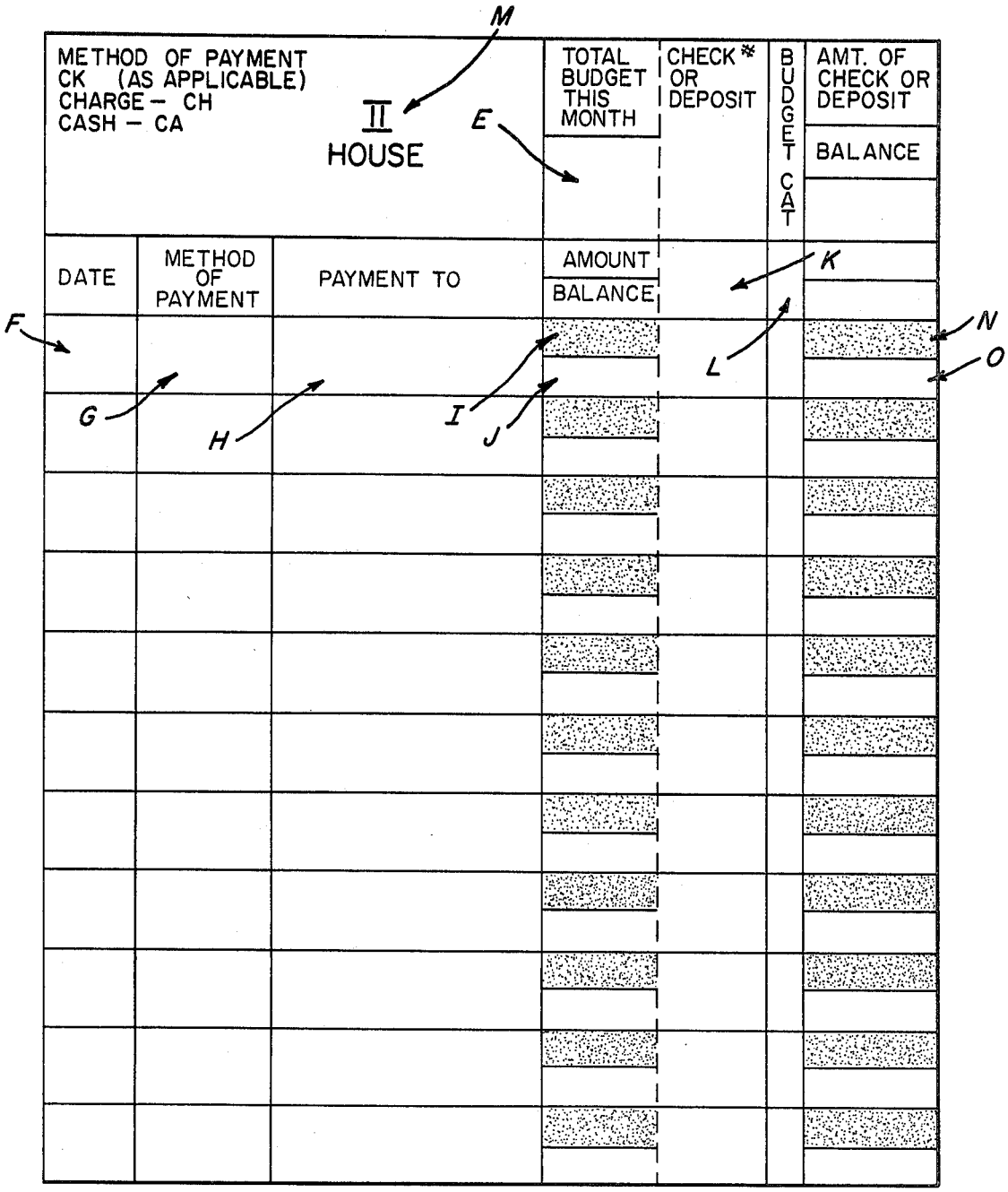
FIG. 5 illustrates a plan view of a budget page of the record book.

FIG. 5 is a plan view of one page of the budget record and adjacent check record. The customer enters the amount budgeted for a particular budget category in a block labeled "TOTAL BUDGET THIS MONTH" E. As he incurs an expenditure, the customer (holding the appropriate tab down) turns quickly to the applicable budget category and records all the data pertinent to the expenditure, i.e., date F, method of payment G, to whom the payment was made H, and the amount of expense incurred is written in the shaded block I. The customer then subtracts the expended amount from the balance in the budget and can instantly see how much he has left to spend in that budget category J. If the method of payment happens to be by check, the customer records the check number in the method of payment block G along with the other pertinent data and then keeps on moving to the right of the booklet, filling in the check number again K, the number of the budget category L (shown above the category in the budget record M), the amount for which the check was written is entered in the shaded block N, and the balance in the checking account recorded underneath it in the unshaded block O.

As can be seen in FIG. 5, the horizontal lines of the budget page are aligned with the horizontal lines of the check page. In some cases, the customer's entry will in fact be along the same matching horizontal lines when entering a budget item paid for by a check. In other cases, prior check or budget entries will be written on their respective check or budget pages and a new entry will not necessarily be aligned in the same horizontal line. Nevertheless, the budget/check book enables entry of pertinent budget and check data in a single fluid motion going from, for example, left to right across both the budget and check pages. The fluid motion is enhanced even further by the provision of a clip to enable quick indexing to the check page having the next sequential blank horizontal line.

Figure 6:
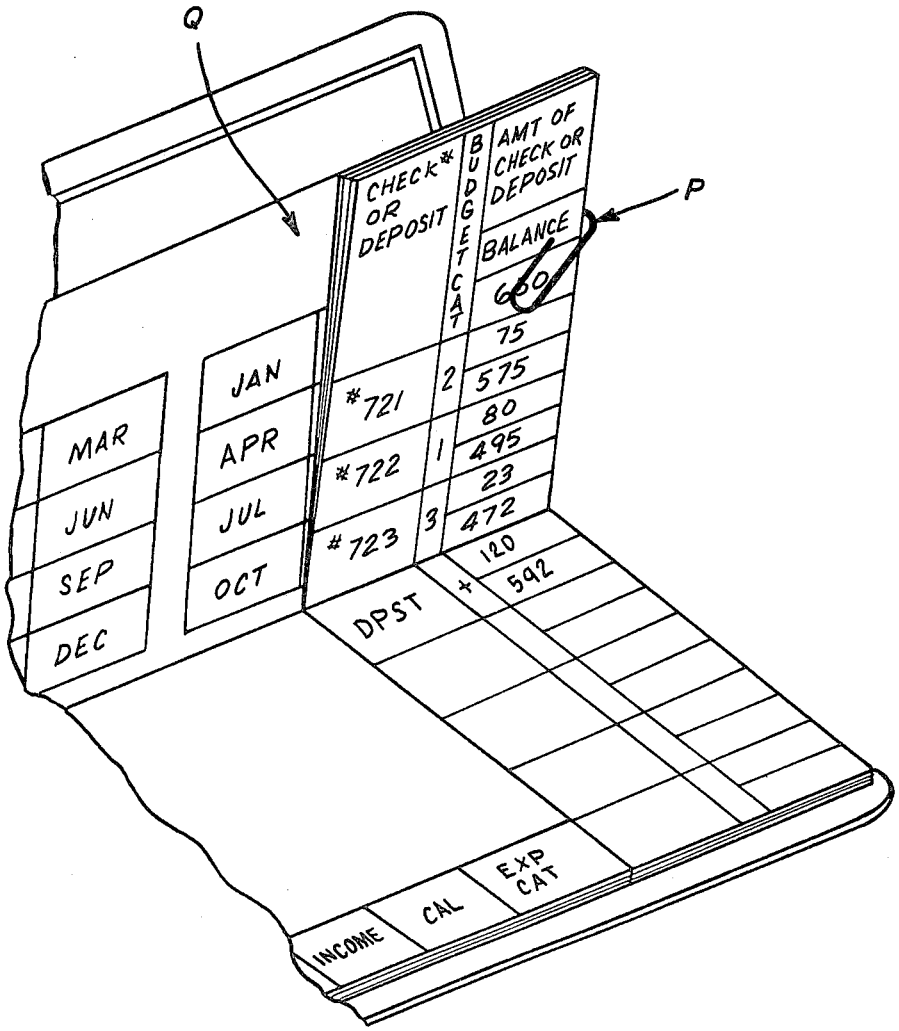
FIG. 6 illustrates the use of the check record pages of the record book.

FIG. 6 illustrates how the check register is utilized. The customer is provided with a paper clip P (or some other instrument) so he can attach the check record to the booklet cover. This offers efficiency in the utilization of this invention in that the customer is able to open his booklet immediately to his last check register entry. As he uses up the check register, the used pages are inserted behind the paper clip. The customer no longer has to take time to flip the used pages when he wants to make an entry, instead he simply opens the cover Q, and his last check record entry and checking account balance is immediately visible.

Figure 7:
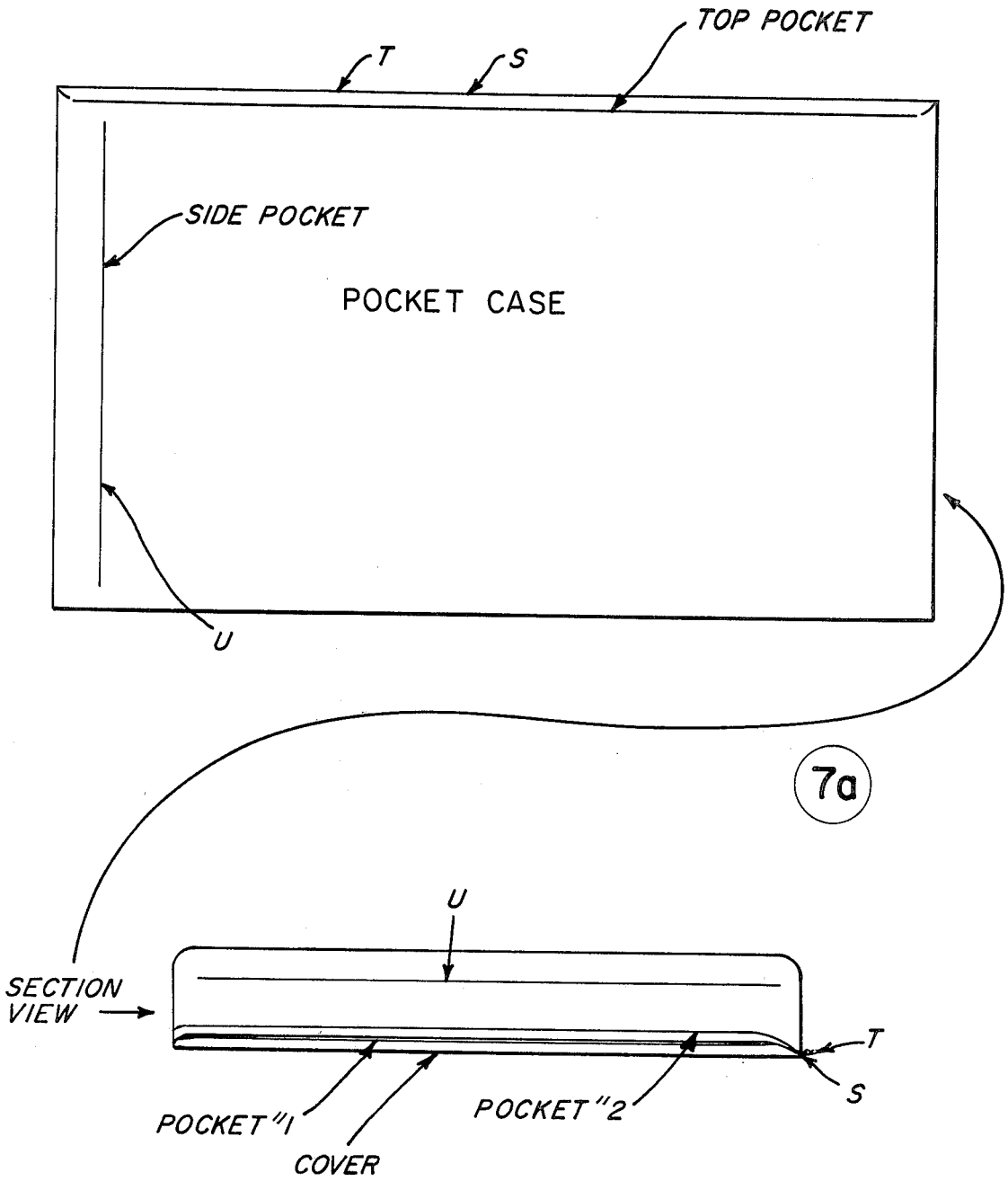
FIG. 7 shows a section of the pocket case for housing the record book.

FIG. 7 illustrates the section of the pocket case that is unique to this invention. A piece of the pocket case material R is attached to the cover of the pocket case S to form a pocket which is open at the top and sealed on both sides and the bottom (the top being the outer edge of the pocket case T). An additional piece of material is placed over that pocket and sealed on all four sides as illustrated by diagram *7a*. The top pocket is then slit along the left side of the pocket case U (using the open ended top pocket as a reference point) approximately 3¼" to accommodate insertion of side-bound checks.

Figure 8:
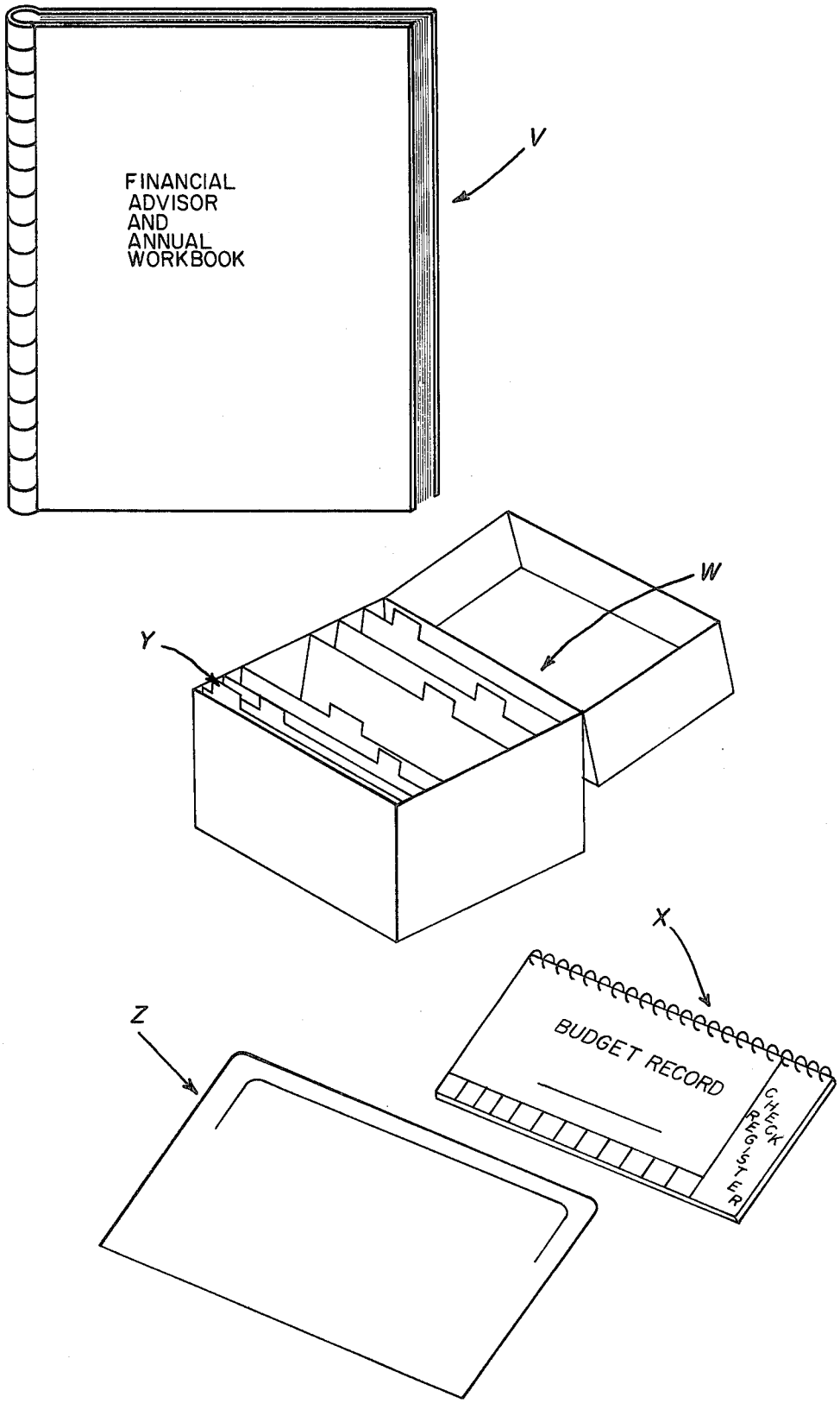
FIG. 8 illustrates the entire system utilizing the record book.

FIG. 8 is an illustration of the whole system: the combination Financial Advisor and workbook V, the file box W, the 12 small monthly booklets which constitute the substance of this invention X, the monthly file card separators Y, and the pocket case Z.

The combination Financial Advisor and Annual Workbook takes the customer through the five basic steps to family financial planning, gives advice on how to cut energy costs and food costs, and walks them through the budgeting process described in the present invention. The customer is then provided annual worksheets which consist of: (1) Inventory Sheets (Possessions/Financial); (2) Balance Sheets (calculate net worth); (3) Annual Financial Goals/Objectives Sheet; (4) Annual Income Projection Sheet; and (5) Expense Category; Worksheets.

The device of present invention breaks the household budget into seven categories: FOOD, HOUSE, TRANSPORTATION, CLOTHING, MEDICAL/-DENTAL, SAVINGS/CHARITY, OTHER MICELLANEOUS. In filling out the expense category worksheet, the customer breaks his budget into items and places them in one of those categories, i.e., HOUSE—mortgage, electric, phone, household insurance, appliance, etc., and then estimates how much he can afford to spend in each category. These "budgets" are then recorded on the applicable Budget Record for that month's booklet (FIG. 5, E). The customer then transfers what he has written in the expense category worksheet of his annual booklet to the expense category worksheet of his portable budget. This helps to remind the customer of the expenses he projected at the beginning of the month and may serve to thwart a tendency to spend outside his budget. FIG. 9 illustrates how this page is utilized.

Figure 10:
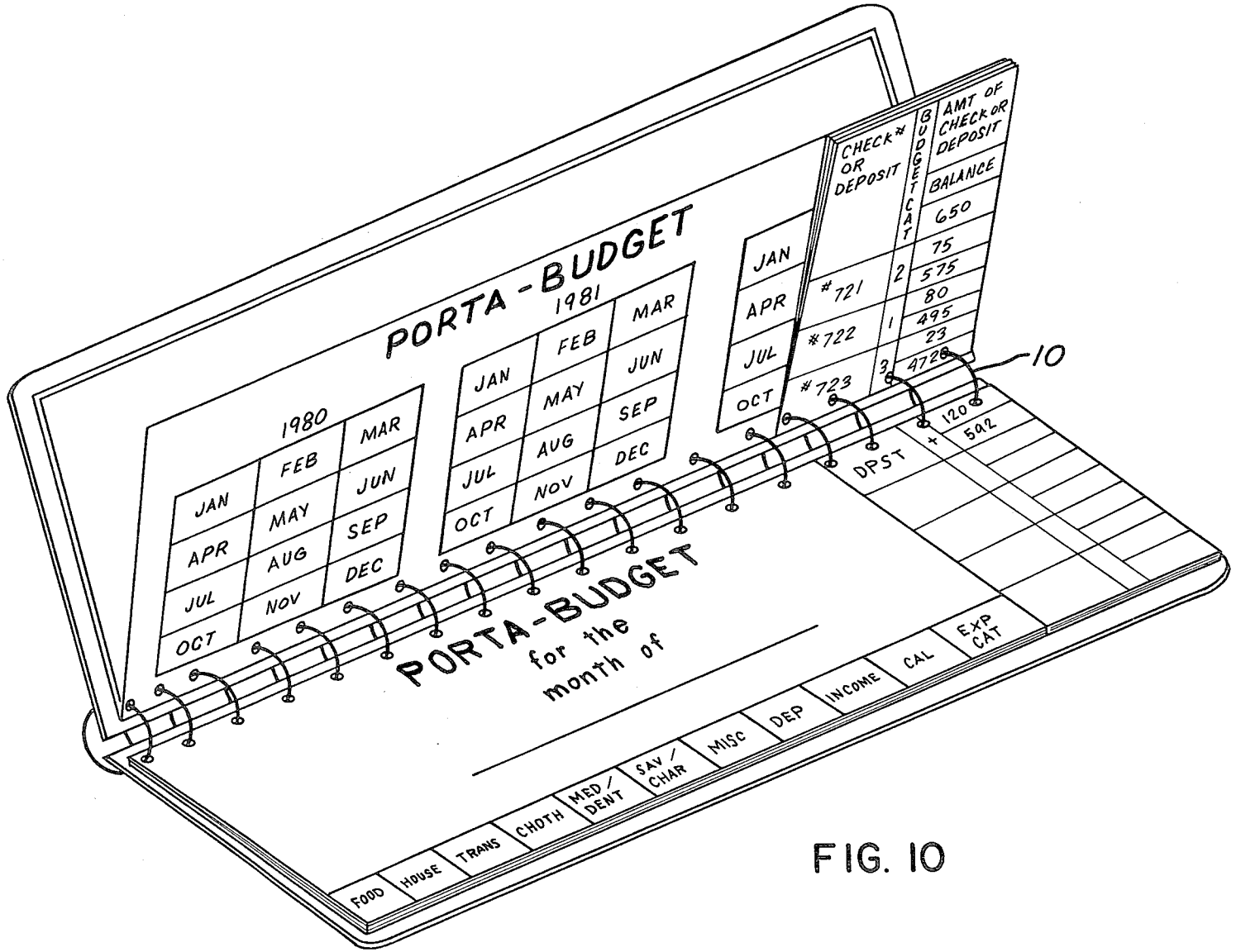
FIG. 10 shows an alternate embodiment of the record book in accordance with the invention.

FIG. 10 shows another embodiment of the invention wherein the budget and check entry pages are secured to a spiral binding member 10. In both FIGS. 1 and 10, the budget pages and check pages form independently movable groups of pages. The budget pages are wider than the check pages (along the binding axis of the record book) extending in width over 50 percent of the width of the record book and most preferably extending at least to about 75 percent of the record book width. The check record pages most preferably extend in width to 25 percent or less of the record book width.

Although there has been shown and described in detail preferred embodiments of this invention, it is apparent that this invention is susceptible of other embodiments in many different forms. The present disclosure is intended to be an exemplification of the principles of the invention and is not intended to limit the invention to the embodiment illustrated. The scope of the invention will be pointed out in the appended claims.

What is claimed is:

1. A register for recording budget items and check items comprising:

(a) a first plurality of sheets having longitudinal lines on both sides thereof and transverse lines, perpendicular to said longitudinal lines, for defining columns for entry of budget items, different categories of budget items identified on said first plurality of sheets, (b) means for securing said first plurality of sheets for movement about a central axis in book-like fashion;

(c) a second plurality of sheets having longitudinal lines on both sides thereof and transverse lines, perpendicular to said longitudinal lines, for defining columns for entry of check items, at least one of said columns on each of said second plurality of sheets for entry of indicia identifying one of said categories of budget items on said first plurality of sheets and another column for identifying a check number, (d) means on said first plurality of sheets for identifying said check numbers on said other columns of said second plurality of sheets, (e) said securing means securing said second plurality of sheets for movement about said central axis in book-like fashion, (f) said first plurality of sheets having a width along said central axis at least twice as great as the width of said second plurality of sheets, and (g) said first and second plurality of sheets each movable independently of one another about said central axis.

2. A register as recited in claim 1, wherein at least some of said first plurality of sheets have index means associated with each of said different categories whereby said first plurality of sheets, when closed in book-like fashion, may be opened directly to a sheet of a selected budget category.

3. A register as recited in claim 2, wherein said index means is positioned at the bottom portion of said first plurality of sheets.

4. A register as recited in claim 3, wherein said index means comprises portions of said first plurality of sheets, said portions extending transverse of said central axis and defining an edge of said first plurality of sheets.

5. A register as recited in claim 1 or 2 further comprising edge attachment means attachable to an edge of said second plurality of sheets for holding an adjustable number of said second plurality of sheets together whereby said second plurality of sheets, when closed in book-like fashion, may be opened directly to a selected sheet of said second plurality of sheets.

6. A register as recited in claim 5, wherein said edge attachment means comprises a clip removable from and fastenable to said second plurality of sheets.

7. A register as recited in claim 1, wherein said means for securing comprises a spiral member and each of said first and second plurality of sheets has apertures adjacent an edge thereof through which said spiral member extends.

8. A register as recited in claim 1, wherein each of said first plurality of sheets is integral with another of said first plurality of sheets along a central bent portion defining said central axis.

9. A register as recited in claim 5 further comprising a cover member extending over said first and second plurality of sheets, said securing means securing said cover member for movement about said central axis, said edge attachment means additionally attachable to said cover member for holding said adjustable member of said second plurality of sheets to said cover member.

10. A register as recited in claim 1, wherein said longitudinal lines of said first and second plurality of sheets are positioned in longitudinal alignment with one another.

11. A register for recording budget items and check items comprising:

(a) a plurality of sheets having longitudinal lines on both sides thereof and transverse lines, perpendicular to said longitudinal lines, for defining columns for entry of budget items in a first portion thereof and check items in a second portion thereof, said sheets having indicia on said first portion thereof identifying different categories of said budget items and means on said first portion thereof for identifying check items of said second portion, (b) said second portion of each of said sheets having a column for entry of said indicia identifying said budget items categories of said first portion of said sheets, (c) means for securing said sheets for movement about a central axis in book-like fashion, and (d) said first and second portions joining one another along a separable edge for manual separation of said first and second portions from one another along said edge, said edge oriented perpendicular to said central axis whereby said first and second portions are, upon separation, movable about said central axis independently of one another.

12. A register as recited in claim 11, wherein at least some of said first portions of said sheets have index means associated with each of said different categories whereby said first portions of said sheets, when closed in book-like fashion, may be opened directly to a sheet of a selected budget category.

13. A register as recited in claim 12, wherein said index means is positioned at the bottom portion of said first portion of said sheets.

14. A register as recited in claim 12, wherein said index means comprises a part of said first portion of said sheets, said part extending transverse of said central axis and defining an edge of said first portions of said sheets.

15. A register as recited in claim 11 or 12, further comprising edge attachment means attachable to an edge of said second portion of said sheets for holding an adjustable member of said second portions of said sheets together whereby said second portions of said sheets, when closed in book-like fashion, may be opened directly to a selected sheet.

16. A register as recited in claim 15, wherein said edge attachment means comprises a clip removable from and fastenable to said second portions of said sheets.

17. A register as recited in claim 15 further comprising a cover member extending over said first and second plurality of sheets, said securing means securing said cover member for movement about said central axis, said edge attachment means additionally attachable to said cover member for holding said adjustable member of said second plurality of sheets to said cover member.

18. A register as recited in claim 11, wherein said means for securing comprises a spiral member and each of said first and second portions of said sheets have apertures adjacent an edge thereof through which said spiral member extends.

19. A register as recited in claim 11, wherein each of said first portions of said sheets is integral with another of said first portions of said sheets along a central bent part defining said central axis.

20. A register as recited in claim 1 or 11 further comprising a case having means for holding said securing means and said plurality of sheets and means for holding a plurality of checks.

21. A register as recited in claim 11, wherein said longitudinal lines of said first and second portions are positioned in alignment with one another.

* * * * *